US007556152B2

(12) United States Patent
Lechelle

(10) Patent No.: US 7,556,152 B2
(45) Date of Patent: Jul. 7, 2009

(54) TRAY FOR PACKAGING OF AN ARTICLE

(75) Inventor: Bernard Lechelle, Faches-Thumesnil (FR)

(73) Assignee: L'oreal, Paris (FR)

( * ) Notice: Subject to any disclaimer, the term of this patent is extended or adjusted under 35 U.S.C. 154(b) by 962 days.

(21) Appl. No.: 10/740,068

(22) Filed: Dec. 19, 2003

(65) Prior Publication Data

US 2004/0182740 A1 Sep. 23, 2004

Related U.S. Application Data

(60) Provisional application No. 60/442,906, filed on Jan. 28, 2003.

(30) Foreign Application Priority Data

Dec. 20, 2002 (FR) ..... 02 16386

(51) Int. Cl.
*B65D 73/00* (2006.01)

(52) U.S. Cl. ..... 206/581; 206/470; 206/509; 206/564

(58) Field of Classification Search ..... 206/463, 206/470, 471, 564, 509, 460, 581, 823, 557; 220/4.23
See application file for complete search history.

(56) References Cited

U.S. PATENT DOCUMENTS 4,512,474 A * 4/1985 Harding ..... 206/461
4,771,934 A * 9/1988 Kalmanides ..... 229/406
5,293,993 A * 3/1994 Yates et al. ..... 206/365
5,513,750 A * 5/1996 Rychel ..... 206/315.1
5,584,387 A * 12/1996 Grant ..... 206/216
5,699,913 A * 12/1997 Richardson ..... 206/470
5,865,013 A * 2/1999 Jackson ..... 53/474
6,012,580 A * 1/2000 Peters et al. ..... 206/470
6,345,716 B1 * 2/2002 Chapman ..... 206/471

FOREIGN PATENT DOCUMENTS

DE 25 57 540 6/1977
EP 0 158 429 10/1985

* cited by examiner

*Primary Examiner*—Jacob K Ackun, Jr.
(74) *Attorney, Agent, or Firm*—Oblon, Spivak, McClelland, Maier & Neustadt, P.C.

(57) ABSTRACT

A tray intended for the packaging of at least one article. The tray includes two parts connected together by an articulation zone enabling the tray parts to pivot relative to each other about an axis X. A first tray part forms at least one open compartment. One of the two parts includes at least two fastening means capable of engaging with two counterpart fastening means formed on the other of the two parts so as to hold both parts in a first position in which the compartment formed by the first part delimits together with the second part a closed recess capable of receiving an article. One of the two parts is also provided with at least two indentations configured to receive, in a second position of the two parts, the fastening means of a second identical tray positioned against the first.

53 Claims, 3 Drawing Sheets

TRAY FOR PACKAGING OF AN ARTICLE

CROSS-REFERENCE TO RELATED APPLICATIONS

This document claims priority to French Application Number 02 16386, filed Dec. 20, 2002, and U.S. Provisional Application No. 60/442,906, filed Jan. 28, 2003, the entire contents of which are hereby incorporated by reference.

BACKGROUND OF THE INVENTION

1. Field of the Invention

The present invention relates to a tray intended for the packaging of an article or plural articles. The invention provides a tray that can be used for transporting an article before and after it is filled with a product.

2. Discussion of Background

Certain articles need to be transported between the time when they are manufactured and the time they are filled with a product, and then again when they are delivered to the point of sale. This notably applies to many articles containing cosmetic products, for example sticks containing a deodorant product with the sticks made at a first manufacturing location, filled with a deodorant product at a second location, and finally marketed at a different point-of-sale location. The sticks are transported between all of these locations and need to be protected in order to arrive at the point of sale in good condition.

Typically, the empty sticks are delivered to the filling location packed in cardboard boxes. Several sticks are placed inside the box, with each stick contained in a plastic bag which is itself surrounded by polyethylene foam in the form of a flexible wrap. Between each stick thus packed, provision is additionally made for polyethylene foam and/or cardboard separators. It is therefore necessary to remove each packaging element in order to take out the sticks before filling them with the product. After filling, each stick is placed in a "bubble-wrap" pocket and then in a standard cardboard box for delivery to the point of sale. A large number of packaging elements is therefore required in this type of packing, which necessitates a lot of handling. In addition, as the packaging is used only once, a great deal of waste is generated.

SUMMARY OF THE INVENTION

One of the objects of the invention is therefore to propose packaging which does not present the drawbacks of the prior art.

A particular object of the invention is to propose packaging which properly protects the articles to be packed while at the same time reducing the number of component elements of the packaging.

A further object of the invention is to propose a packaging arrangement which can be used several times during transportation of the articles to be packed, up to and including delivery to their point of sale.

According to the invention, these objects are achieved by making a tray intended for the packaging of at least one article. The tray includes two parts connected together by an articulation zone enabling them to pivot relative to each other about an axis X. A first part forms at least one open compartment. One of the tray parts includes a fastener part which mates with a counterpart or mating fastener part of the second tray part. In a preferred arrangement, one of the two parts includes at least two fastening means capable of engaging with two counterpart or mating fastening means formed on the other of the two parts so as to hold both parts in a first position in which the compartment, formed by the first part delimits, together with the second part, a closed recess capable of receiving an article. One of the two parts is also provided with at least two indentations configured to receive, in a second position of the two parts, the fastening means of a second identical tray positioned against the first.

Thus, the same tray can be used to package at least one article in two different positions, by itself or in conjunction with a second tray.

According to the configuration of one example, the indentations or recesses can be formed on the same part as the fastening means with each fastening means being aligned respectively with an indentation on an axis parallel to the axis X.

The fastening means can be, for example, in the form of a lug or projection and the counterpart or mating fastening means can be in the form of a cavity or recess designed to receive a tightly fitting lug. The cavities can have, for example, a circular or rounded cross-section and the lugs can have, for example, at least one flat side or corner with, e.g., a square or polygonal cross-section. It is to be understood that the shape and dimensions of the transverse cross-section of the lugs and cavities will be chosen so that they cooperate with each other so as to form a relatively solid or reliable means of fastening while at the same time being reversible.

The indentations can be configured to receive, preferably in a loose-fitting manner, the fastening means of an identical second tray positioned against the first. Thus, when the articles are delivered packaged between two trays, it is relatively easy to separate the two trays in order to take out the articles. This is particularly advantageous when the articles thus delivered are intended to feed a production line on which the articles are modified, for example in the case of deodorant sticks, by filling them with a product.

According to the configuration of one example, the second part forms at least one open compartment, symmetrical relative to axis X to the compartment formed by the first part. In addition, the two compartments are designed, in the first position, to delimit the closed recess for the article. Each compartment can, for example, take the form of a half-cylinder. However, the compartments can have other shapes, the shape preferably being chosen in relation to that of the article to be packaged so as to conform as closely as possible to it.

The tray can be formed by molding a thermoplastic material from a single piece, for example, by thermoforming or thin-wall injection molding. The tray is, for example, made of a thermoplastic material chosen among the polyvinyl chlorides, polypropylenes, polyethylenes, polystyrenes, or a complex of materials of the type polypropylene/ethylene vinyl alcohol (EVOH)/polypropylene, polyethylene/polyethylene terephthalate, or polystyrene/EVOH/polyethylene.

The invention also relates to a process for the packaging of articles intended to contain a product. The process includes providing at least two articles, containing no product, in a packaging formed by two trays placed against each other. Each article is disposed within a closed recess delimited by a compartment of one of the two trays and by a compartment of the other of the two trays. The two trays are separated and the articles are withdrawn. The articles are then filled with a product, an article filled with a product is placed into a compartment of one of the two trays and another article filled with a product is placed into a compartment of the other of the two trays. Both parts of each tray are then pivoted relative to each other to put the trays in a position so that each tray delimits a closed recess containing an article.

The article can be in stick form and can contain a cosmetic product, for example, a deodorant or an antiperspirant.

BRIEF DESCRIPTION OF THE DRAWINGS

Other characteristics and advantages of the invention will become apparent from the following detailed description, particularly when considered in conjunction with the drawings in which.

DETAILED DESCRIPTION OF THE PREFERRED EMBODIMENTS

Figure 1:
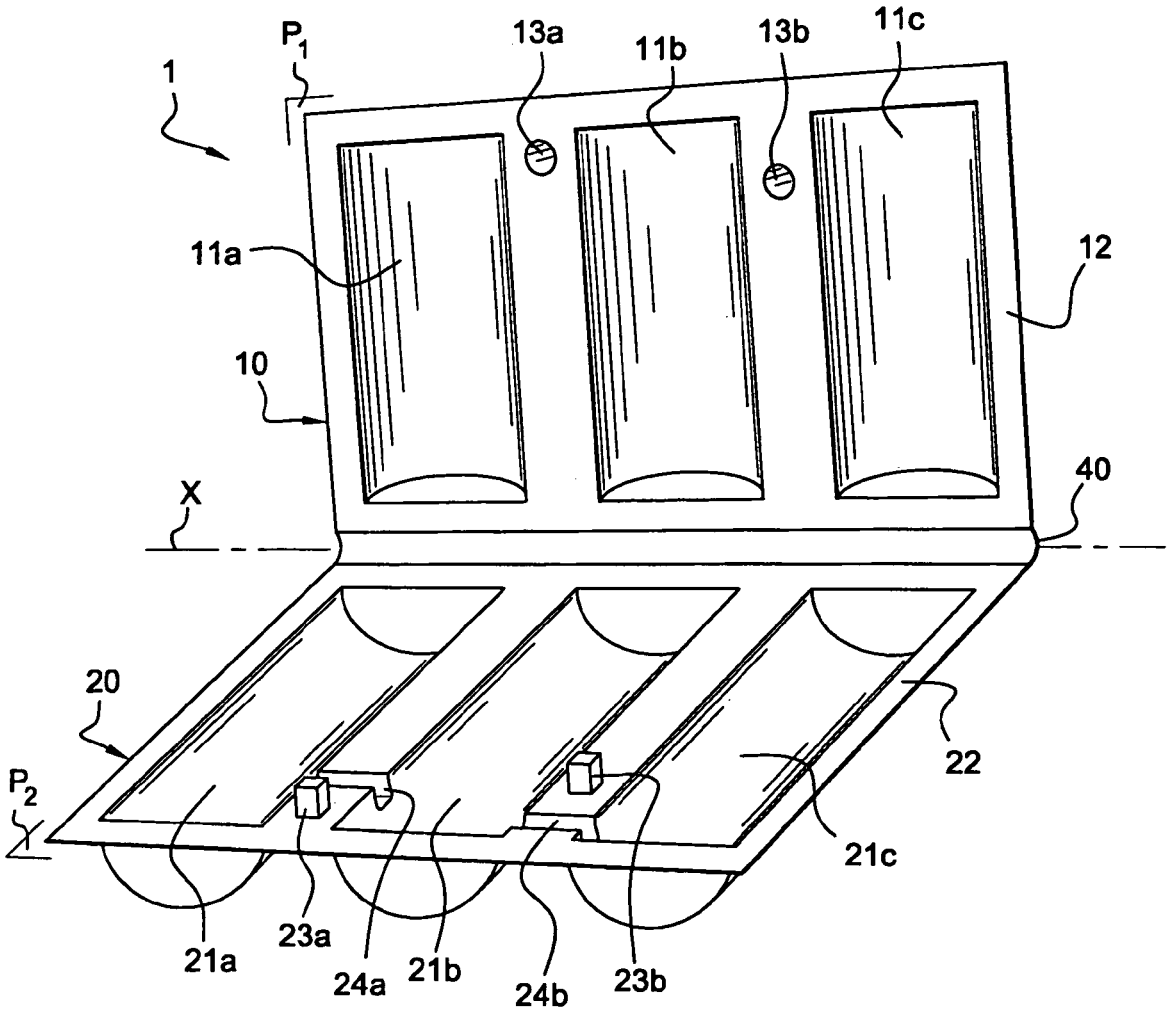
FIG. 1 illustrates a perspective view of a tray according to the invention.

FIG. 1 shows an exemplary embodiment of a packaging tray 1 according to the invention. The tray 1 includes a body, preferably made of thermoplastic material, composed of two parts 10 and 20 connected together by an articulation zone 40 enabling them to pivot relative to each other about an axis X.

The tray can be obtained, for example, by thermoforming or by thin-wall injection molding from a single piece of a thermoplastic material chosen among materials such as polyvinyl chlorides, polypropylenes, polyethylenes, polystyrenes, or a complex of materials of the type polypropylene/ethylene vinyl alcohol (EVOH)/polypropylene, polyethylene/polyethylene terephthalate, or polystyrene/EVOH/polyethylene. According to one preferred example, the tray is obtained by thermoforming a mixture of polystyrene and polyethylene. The tray thus obtained has a relatively soft surface so that it does not damage the packaged article.

The first tray part 20 also includes three compartments 21*a*, 21*b* and 21*c* which also have the shape of a half-cylinder. The compartments 21*a* to 21*c* and 11*a* to 11*c* are respectively symmetrical about the axis X. Compartments 21*a* to 21*c* each have an opening which extends in a plane $P_2$, and are connected to each other by a flange 22 also extending in the plane $P_2$.

According to the example illustrated, the second tray part 10 includes three compartments 11*a*, 11*b* and 11*c*, each having the shape of a half-cylinder. These compartments each have an opening which extends in a plane $P_1$, and are connected to each other by a flange 12 also extending in the plane $P_1$.

Two depressions or recesses 13*a* and 13*b* are formed on the flange 12 of the second part 10, on either side of the middle compartment 11*b*. Depressions 13*a* and 13*b* have a circular cross-section, for example. A first depression 13*a* is formed at a first distance from the axis X. Preferably, a second depression 13*b* is formed at a second distance from the axis X so that the two depressions are not aligned on an axis parallel to axis X.

Two lugs or projections 23*a* and 23*b* are formed on the flange 22 of the first tray part 20, on either side of the middle compartment 21*b*, with each lug intended to engage with each depression 13*a* and 13*b* to form a fastening arrangement. Lug 23*a* is formed at the same distance from axis X as depression 13*a* and lug 23*b* is formed at the same distance from axis X as depression 13*b* so that they are symmetrical relative to the axis X. The lugs have a square cross-section and are intended to fit into one of the depressions to their full height. In addition, the circle described by the transverse cross-section of the lug (e.g., a circle that would be formed by rotating the transverse cross-section or having a diameter of the size of the diagonal of the transfer cross-section) is substantially of the same radius as the cross-section of the depression, or substantially greater so that the lug is a tight fit in the depression. Lugs 23*a* and 23*b* extend on one side of the plane $P_2$.

Two indentations or recesses 24*a* and 24*b* are formed on the flange of the first tray part 20, on the other side of the plane $P_2$ relative to the lugs. A first indentation 24*a* is aligned with lug 23*b* on an axis parallel to axis X and with lug 23*a* on an axis perpendicular to axis X. The second indentation 24*b* is aligned with lug 23*a* on an axis parallel to axis X and with lug 23*b* on an axis perpendicular to axis X. Each indentation has a sufficiently large cross-section to be able to receive a lug of another device in a loose-fitting manner. The indentations take the form of a groove but it is evident that any other indented shape can be used to receive the lugs in a loose-fitting manner, by choosing an indented form of transverse cross-section greater than the transverse cross-section of the lugs.

Such a tray can be used, for example, to package a stick or container having a cylindrical shape designed to contain a deodorant product. It is evident that the shape of each compartment will depend on the shape of the article to be packaged.

The tray is used in the following manner. First, six sticks without product are placed in the six compartments of a first packaging tray 1. The tray 1 is in a first position, i.e. fully open, with the planes $P_1$ and $P_2$ being coincident at this time. A second tray 100, identical to the first, is placed against the latter so that the flanges 112 and 122 of the second tray 100 are in contact with the flanges 12 and 22 of the first tray 1, with the six compartments of the second tray 100 then respectively facing the six compartments of the first tray 1 so as to form paired closed recesses for the sticks.

Figure 2:
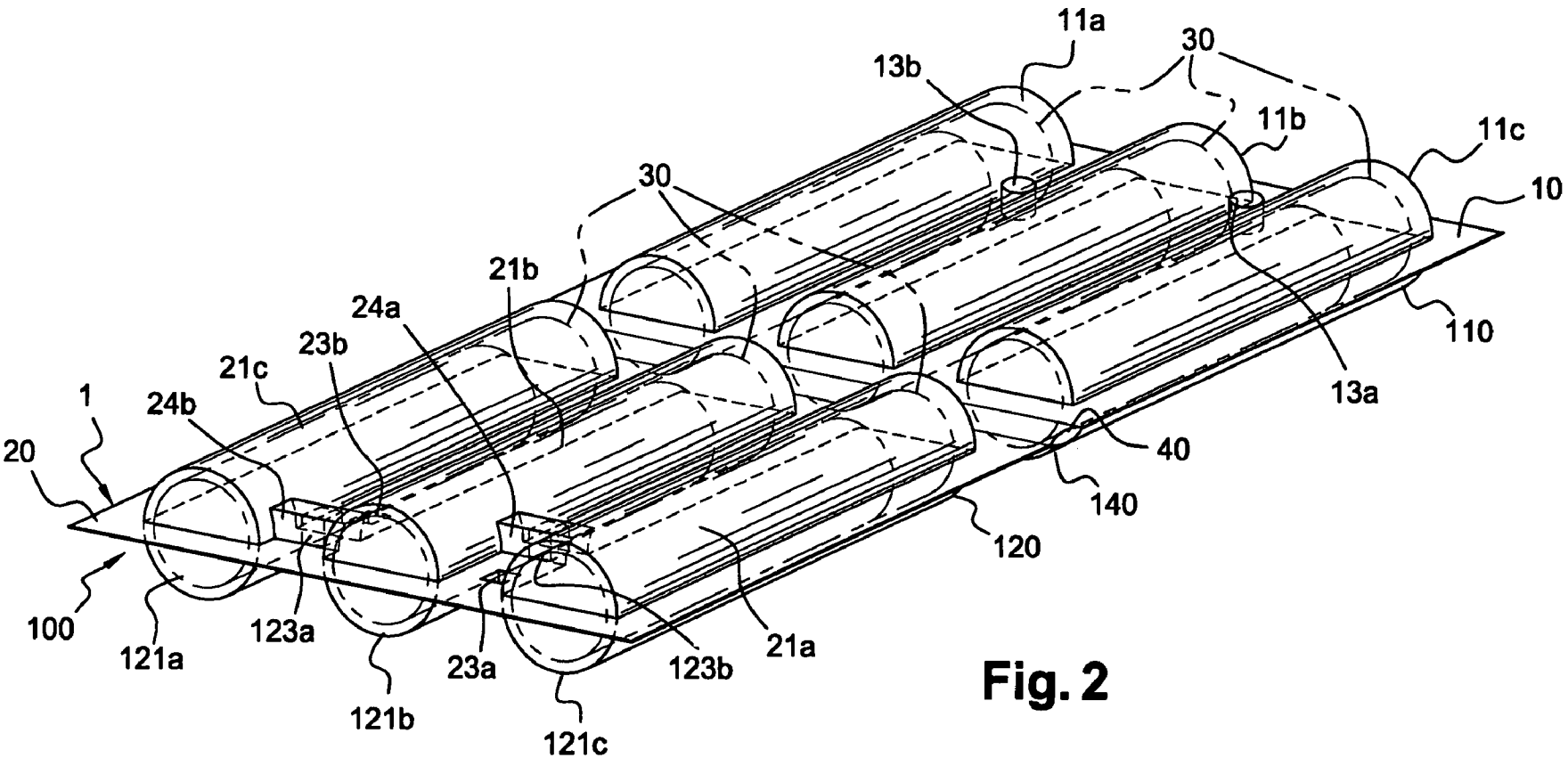
FIG. 2 shows the tray in FIG. 1 in a second packaging position.

In this position, illustrated in FIG. 2, the recesses are preferably configured so as to conform perfectly or closely to the shape of the sticks and thus hold them in position so that they do not move during transport. They are thus well protected for transport. In this position, lugs 23*a* and 23*b* of the first tray 1 are lodged in the indentations 124*b* and 124*a* of the second tray 100 and the lugs 123*a* and 123*b* of the second tray 100 are lodged in the indentations 24*b* and 24*a* of the first tray 1. Thus, with such a packaging arrangement containing empty sticks or containers without product, the two superimposed trays can be easily separated because the lugs are not tight fitting in the indentations.

The sticks can then be filled with a product by any known filling process.

Figure 3:
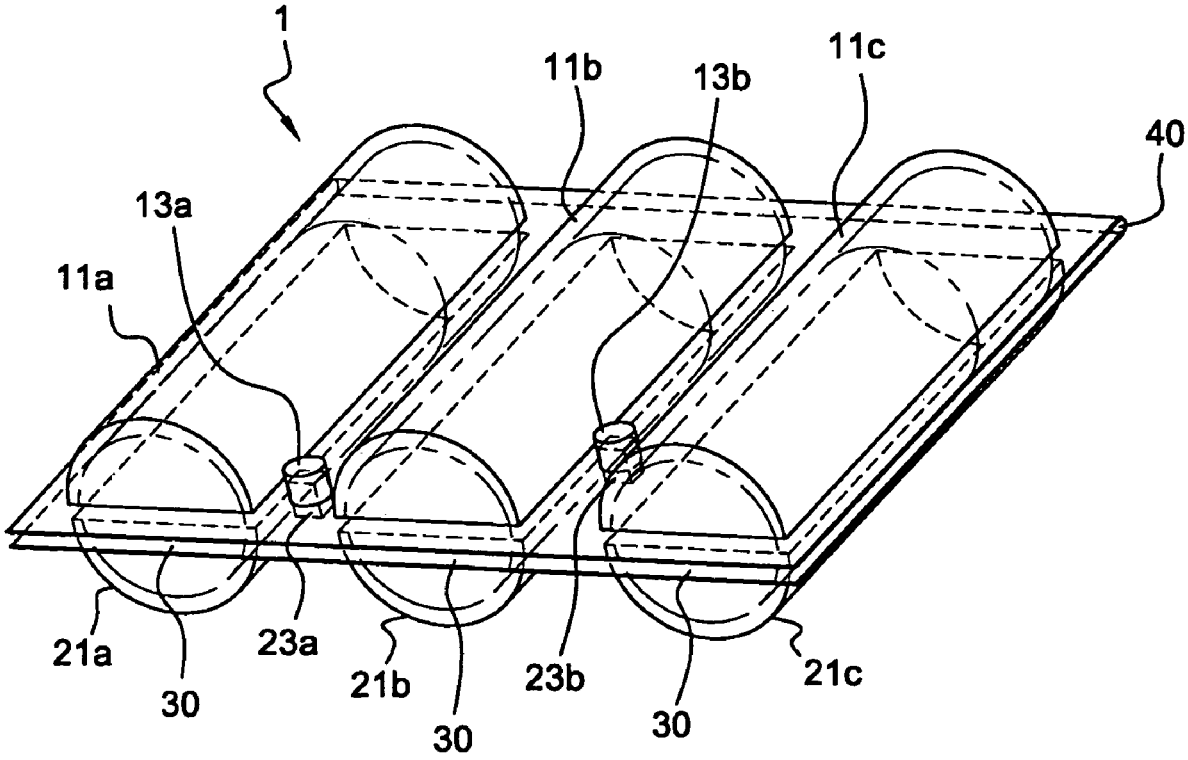
FIG. 3 shows the tray in FIG. 1 in a first packaging position.

Once the sticks have been filled with the product, they are re-packaged for transportation to their point of sale. To do this, each tray 1 and 100 is recovered and three sticks are placed in compartments 11*a*, 11*b* and 11*c* of the first tray 1, and three sticks are placed in compartments 111*a*, 111*b* and 111*c* of the second tray 100. For each tray, the second part is pivoted relative to the first part about the axis X so as to enclose the sticks in a closed recess as shown in FIG. 3. In this position, the sticks are again held securely in place because the compartments conform to their shape and maintain them in position thus avoiding movement during transport. In this position, the lugs 23*a* (123*a*) and 23*b* (123*b*) are inserted tightly into the cavities 13*a* (113*a*) and 13*b* (113*b*) so that each tray is perfectly maintained in this position.

The trays can then be placed in cardboard packing cases for delivery to their point of sale. The trays are, for example, stacked in a cardboard packing case, maintaining perfect alignment on top of each other. Alternatively, provision can be made to stack the trays with a slight offset between pairs so that the prominences formed by the half-cylinders of one tray are seated in the recessed portions located between two half-cylinders of the previous tray. The sticks are thus more effectively secured and held in place.

Thus, as can be appreciated, with the arrangement of the invention, first and second tray parts are provided which can be moved between an open position and a closed position, with the first and second tray parts mating with each other in the closed position. Further, when the tray is in the open position, it can mate with another like or similar tray, preferably with the respective first tray parts facing each other. In addition, fastener parts can be provided to further connect or couple the parts in the various positions. In the illustrated embodiment, first, second and third fastener parts are provided, with the first and third fastener parts provided on the first tray part and the second fastener part provided on the second tray part. In the illustrated preferred embodiment, each tray includes two of each of the fastener parts. Thus, when a given tray is closed, the first fastener parts mate with the second fastener part. When the trays are open and one tray is mating with another tray, the first fastener part of one tray can mate with the third fastener part of another tray. As illustrated and described by way of example, the first fastener parts can be lugs or projections, with the second and third fastener parts cavities, indentations or recesses.

Such packaging arrangements make it possible to reduce handling and also to reduce or eliminate non-reusable packaging.

Obviously, numerous modifications and variations of the present invention are possible in light of the above teachings. It is therefore to be understood that, within the scope of appended claims, the invention may be practiced otherwise than as specifically described herein.

What is claimed as new and desired to be secured by letters patent of the united states is:

1. A tray for packaging at least one article comprising:

first and second parts connected together by an articulation zone enabling the first and second parts to pivot relative to each other about an axis X, such that the tray is movable between a first position in which the tray is open and a second position in which the tray is closed;

wherein the first part includes at least one open compartment, and one of the first and second parts includes at least two fastening means which mate with at least two counterpart means formed on the other of the two parts so as to hold both parts in the second position in which the compartment of the first part delimits together with the second part a recess capable of receiving an article;

wherein one of the first and second parts further includes at least two indentations configured to receive and mate with, in the first position of the first and second parts, the fastening means of a second identical tray positioned against said tray such that the two fastening means and the two indentations hold the tray and the second identical tray together; and wherein the fastening means mate with said counterpart means more tightly than said fastening means mate with said indentations.

2. A tray according to claim 1, wherein:

the indentations are formed on the same one of said first and second parts as the fastening means, and wherein each fastening means is aligned with a respective indentation on an axis parallel to the axis X.

3. A tray according to claim 2, wherein the fastening means are each in the form of a lug and the counterpart means are each in the form of a cavity arranged to tightly receive a lug.

4. A tray according to claim 3, wherein the cavities have a circular cross-section.

5. A tray according to claim 4, wherein the lugs have a square cross-section which is received within the circular cross-section in the second position.

6. A tray according to claim 3, wherein the lugs have a square cross-section.

7. A tray according to claim 1, wherein the fastening means are each in the form of a lug and the counterpart means are each in the form of a cavity arranged to tightly receive a lug.

8. A tray according to claim 1, wherein the indentations are configured to receive in a loose-fitting manner the fastening means of an identical second tray positioned against said tray.

9. A tray according to claim 1, wherein the second part includes at least one open compartment which is symmetrical relative to axis X to the at least one open compartment of the first part, the compartment of the second part being arranged, in the second position, to delimit together with the compartment of the first part the recess for the article.

10. A tray according to claim 9, wherein the at least one compartment of the first part and the at least one compartment of the second part each have a shape of a half-cylinder.

11. A tray according to claim 9, wherein the at least one compartment of the first part and the at least one compartment of the second part each have a shape which is the same.

12. A tray according to claim 1, wherein said tray is formed by molding a thermoplastic material as a single piece.

13. A tray according to claim 12, wherein said tray is formed by one of thermoforming and thin-wall injection molding.

14. A tray according to claim 13, wherein said tray is made of a thermoplastic material selected from the group consisting of: polyvinyl chlorides, polypropylenes, polyethylenes, polystyrenes, or a complex of materials of the type polypropylene/ethylene vinyl alcohol (EVOH)/polypropylene, polyethylene/polyethylene terephthalate, or polystyrene/EVOH/polyethylene.

15. A tray according to claim 1, wherein said tray is made of a thermoplastic material selected from the group consisting of: polyvinyl chlorides, polypropylenes, polyethylenes, polystyrenes, or a complex of materials of the type polypropylene/ethylene vinyl alcohol (EVOH)/polypropylene, polyethylene/polyethylene terephthalate, or polystyrene/EVOH/polyethylene.

16. A tray according to claim 1, in combination with a second identical tray in said first position, wherein in said first position a first article receiving recess is formed by facing compartments of respective first parts of said trays, and further wherein the second part of each tray includes at least one compartment, and wherein when said trays are in said first position a second article receiving recess is formed by facing compartments of said second parts of said trays.

17. An arrangement according to claim 16, further including a first article disposed in said first recess and a second article disposed in said second recess.

18. An arrangement according to claim 17, wherein said first and second articles comprise containers for a cosmetic product.

19. A tray according to claim 1, wherein said first part includes a flange surrounding said at least one compartment, and wherein said at least two fastening means and said at least two indentations are positioned on said flange.

20. A tray according to claim 19, wherein said first part includes a plurality of said compartments, and wherein at least one of said fastening means and at least one of said indentations are disposed on flange portions between adjacent compartments.

21. A tray according to claim 20, wherein said second part includes a plurality of compartments respectively facing the plurality of compartments of said first part in said first position, said second part including a flange extending about the plurality of compartments of the second part, and wherein at least one of said counterpart means is disposed on a portion of said flange which is between adjacent compartments of said second part.

22. A tray according to claim 21, wherein in the first position of said tray said flange of said first part is substantially parallel to said flange of said second part.

23. A tray according to claim 22, wherein one of said fastening means and one of said indentations are positioned on said first part such that an axis aligned with said one of said fastening means and said one of said indentations is parallel to said axis X.

24. A tray according to claim 1, wherein the first part includes a plurality of compartments, and wherein at least one of said fastening means and at least one of said indentations are positioned between adjacent compartments.

25. A tray according to claim 24, wherein said second part includes a plurality of compartments, and wherein when said tray is in said second position, compartments of said first part are aligned with compartments of the second part to form a plurality of recesses for receiving articles, and further wherein when the second identical tray is positioned against said tray in the first position, compartments of the second tray are aligned with compartments of the first tray to provide a first plurality of article receiving recesses associated with the first parts of the trays and a second plurality of recesses associated with the second parts of the trays.

26. A tray according to claim 1, wherein the first part includes a plurality of compartments and the second part includes a plurality of compartments, and wherein in said second position the compartments of the first part are aligned with the compartments of the second part to define a plurality of article receiving recesses, and further wherein when a second identical tray is positioned against said tray in the first position, compartments of said tray are aligned with compartments of said second identical tray to define a first plurality of article receiving recesses associated with the first parts of the trays and a second plurality of recesses associated with the second parts of the trays.

27. A tray according to claim 26, wherein the counterpart means each include a recess, and wherein when the fastening means are received in the indentations with a second identical tray positioned against said tray said recesses of said counterpart means are vacant.

28. A tray according to claim 2, wherein the first part includes a plurality of compartments, and wherein at least one of said fastening means and at least one of said indentations are positioned between adjacent compartments.

29. A tray according to claim 2, wherein the first part includes a plurality of compartments and the second part includes a plurality of compartments, and wherein in said second position the compartments of the first part are aligned with the compartments of the second part to define a plurality of article receiving recesses, and further wherein when a second identical tray is positioned against said tray in the first position, compartments of said tray are aligned with compartments of said second identical tray to define a first plurality of article receiving recesses associated with the first parts of the trays and a second plurality of recesses associated with the second parts of the trays.

30. A tray according to claim 2, wherein the counterpart means each include a recess, and wherein when the fastening means are received in the indentations with a second identical tray positioned against said tray said recesses of said counterpart means are vacant.

31. A tray according to claim 2, wherein one of said indentations and one of said fastening means are aligned on a first axis parallel to said axis X, and further wherein another of said indentations and another of said fastening means are aligned on a second axis parallel to said axis X, and wherein said first and second axes are spaced at different distances from the axis X.

32. A tray according to claim 31, wherein the first part includes a plurality of compartments and the second part includes a plurality of compartments, and wherein said fastening means and said indentations are positioned between adjacent compartments.

33. A tray according to claim 2, wherein when said tray is in said second position said indentations are vacant, and further wherein when a second identical tray is positioned against said tray such that the fastening means of the second identical tray mate with the indentations said counterpart means are vacant.

34. A tray arrangement for packaging at least one article comprising:

first and second trays, each of said first and second trays including a first tray part and a second tray part wherein said first and second tray parts are movable relative to each other between an open position and a closed position, and wherein said first tray part includes at least one compartment, and further wherein in said closed position said first tray part mates with said second tray part and a product receiving recess is provided between said at least one compartment and said second tray part; and wherein said first and second trays mate with each other with the first tray part of the first tray mating with the first tray part of the second tray when said first and second trays are in their open positions, and wherein when said first and second trays mate with each other another product receiving recess is defined between the at least one compartment of the first tray part of the first tray and the at least one compartment of the first tray part of said second tray;

wherein the first tray part of each tray includes a first fastener part and the second tray part of each tray includes a second fastener part, and wherein in said closed position of each tray the first fastener part mates with the second fastener part;

wherein the first tray part of each tray further includes a third fastener part, and wherein when said first tray mates with said second tray said first fastener part of said first tray mates with the third fastener part of said second tray and the first fastener part of said second tray mates with the third fastener part of said first tray; and wherein when the first and second trays are in the closed position, the respective third fastener parts do not mate with another fastener part.

35. A tray arrangement as recited in claim 34, wherein said first fastener part of each tray includes a projection.

36. A tray arrangement as recited in claim 35, wherein each of the second and third fastener parts includes a recess.

37. A tray arrangement as recited in claim 36, wherein said second fastener part receives said first fastener part with a tighter fit than said third fastener part receives said first fastener part.

38. A tray arrangement as recited in claim 37, wherein each of said first and second trays includes at least two of said first fastener parts, at least two of said second fastener parts, and at least two of said third fastener parts.

39. A tray arrangement as recited in claim 38, wherein each tray is movable from said open position to said closed position by pivoting the first and second parts relative to each other about a pivot axis;

wherein for each of said first and second trays, one of said at least two first fastener parts is positioned on the first tray part at a distance from said pivot axis which is greater than a distance from said pivot axis at which another of said at least two first fastener parts is positioned on said first tray part; and wherein for each of said first and second trays one of said at least two third fastener parts is positioned on the first tray part at a distance from said pivot axis which is greater than a distance from said pivot axis at which another of said at least two third fastener parts is positioned on said first tray part.

40. A tray arrangement as recited in claim 39, wherein for each of said first and second trays, a first axis aligned with said one of said first fastener parts and said one of said third fastener parts is substantially parallel to said pivot axis, and wherein a second axis aligned with said another of said first fastener parts and said another of said third fastener parts is substantially parallel to said pivot axis.

41. A tray arrangement as recited in claim 40, wherein the second tray part of each of said first and second trays includes at least one compartment which faces the at least one compartment of the first tray part when each tray is in said closed position.

42. A tray arrangement as recited in claim 41, wherein the first and second tray parts of each of said first and second trays each includes a plurality of compartments and wherein a flange extends about said compartments, and wherein at least one of each of said first, second and third fastener parts is disposed on said flange between adjacent compartments of said plurality of compartments.

43. A tray arrangement as recited in claim 34, wherein each of said first and second trays includes at least two of said first fastener parts, at least two of said second fastener parts, and at least two of said third fastener parts;

wherein each tray is movable from said open position to said closed position by pivoting the first and second parts relative to each other about a pivot axis;

wherein for each of said first and second trays, one of said at least two first fastener parts is positioned on the first tray part at a distance from said pivot axis which is greater than a distance from said pivot axis at which another of said at least two first fastener parts is positioned on said first tray part; and wherein for each of said first and second trays one of said at least two third fastener parts is positioned on the first tray part at a distance from said pivot axis which is greater than a distance from said pivot axis at which another of said at least two third fastener parts is positioned on said first tray part.

44. A tray arrangement as recited in claim 43, wherein for each of said first and second trays, a first axis aligned with said one of said first fastener parts and said one of said third fastener parts is substantially parallel to said pivot axis, and wherein a second axis aligned with said another of said first fastener parts and said another of said third fastener parts is substantially parallel to said pivot axis.

45. A tray arrangement as recited in claim 44, wherein the second tray part of each of said first and second trays includes at least one compartment which faces the at least one compartment of the first tray part when each tray is in said closed position.

46. A tray arrangement as recited in claim 45, wherein the first and second tray parts of each of said first and second trays each includes a plurality of compartments and wherein a flange extends about said compartments, and wherein at least one of each of said first, second and third fastener parts is disposed on said flange between adjacent compartments of said plurality of compartments.

47. A tray arrangement as recited in claim 34, wherein the second tray part of each of said first and second trays includes at least one compartment which faces the at least one compartment of the first tray part when each tray is in said closed position.

48. A tray arrangement as recited in claim 47, wherein the first and second tray parts of each of said first and second trays each includes a plurality of compartments and wherein a flange extends about said compartments, and wherein at least one of each of said first, second and third fastener parts is disposed on said flange between adjacent compartments of said plurality of compartments.

49. A tray arrangement as recited in claim 34, further including an article disposed in said another product receiving recess with said first tray mating with said second tray.

50. A tray arrangement as recited in claim 49, wherein said article is a cosmetic container.

51. A tray arrangement as recited in claim 49, wherein said article is a deodorant container which is not yet filled.

52. A tray arrangement as recited in claim 34, wherein each tray includes a first plurality of said product receiving recesses when said first tray part mates with said second tray part, and wherein said first and second trays together include a second plurality of said another product receiving recesses when said first and second trays mate with each other, and wherein said second plurality is twice as many as said first plurality.

53. A tray arrangement as recited in claim 34, wherein when the first tray mates with the second tray, the respective second fastener parts do not mate with another fastener part.

* * * * *